US010845059B2

(12) United States Patent
Mizusaki et al.

(10) Patent No.: US 10,845,059 B2
(45) Date of Patent: Nov. 24, 2020

(54) ELECTRIC OVEN

(71) Applicant: SAMSUNG ELECTRONICS CO., LTD., Suwon-si (KR)

(72) Inventors: Soichiro Mizusaki, Suwon-si (KR); Haengdeog Koh, Hwaseong-si (KR); Doyoon Kim, Hwaseong-si (KR); Seyun Kim, Seoul (KR); Jinhong Kim, Seoul (KR); Hajin Kim, Hwaseong-si (KR); Minjong Bae, Yongin-si (KR); Hiesang Sohn, Seoul (KR); Changsoo Lee, Seoul (KR)

(73) Assignee: SAMSUNG ELECTRONICS CO., LTD., Gyeonggi-Do (KR)

( * ) Notice: Subject to any disclaimer, the term of this patent is extended or adjusted under 35 U.S.C. 154(b) by 436 days.

(21) Appl. No.: 15/833,519

(22) Filed: Dec. 6, 2017

(65) Prior Publication Data

US 2018/0163971 A1 Jun. 14, 2018

(30) Foreign Application Priority Data

Dec. 8, 2016 (KR) ..... 10-2016-0166883

(51) Int. Cl.
*F24C 7/06* (2006.01)
*F24C 7/08* (2006.01)
(Continued)

(52) U.S. Cl.
CPC ..... *F24C 7/081* (2013.01); *F24C 7/043* (2013.01); *F24C 7/062* (2013.01); *F24C 7/067* (2013.01);
(Continued)

(58) Field of Classification Search
CPC ..... F24C 7/04–046; F24C 7/06–065; F24C 7/081; A21B 1/22; H05B 3/26–267; H05B 3/28–30
(Continued)

(56) References Cited

U.S. PATENT DOCUMENTS 4,298,789 A * 11/1981 Eichelberger ..... H05B 3/262 219/391
5,616,266 A * 4/1997 Cooper ..... F24C 7/06 219/407
(Continued)

FOREIGN PATENT DOCUMENTS

JP 1999125430 A 5/1999
JP 2003203689 A 7/2003
(Continued)

OTHER PUBLICATIONS

Ninomiya Electric Wire Co., LTD., 2014, 3 pages "http://www.ninomiya-ew.co.jp/products/cerac-sl.html", Retrieved on Nov. 29, 2017.

*Primary Examiner* — David P Angwin
*Assistant Examiner* — Nicholas A Ros
(74) *Attorney, Agent, or Firm* — Cantor Colburn LLP

(57) ABSTRACT

An electric oven includes a top plate and a bottom plate facing each other, two side plates facing each other, and a rear plate connecting the top plate, the bottom plate and the two side plates where the top plate, the bottom plate, the two side plates and the rear plate define a cavity having a front opening, a door which selectively opens and closes the front opening of the cavity, a casing which surrounds the cavity, a support member interposed between the casing and the cavity, and one or more planar heating elements which extend along one plane, are detachably supported by the support member, and apply radiant heat to the cavity.

17 Claims, 10 Drawing Sheets

(51) Int. Cl.
*F24C 7/04* (2006.01)
*H05B 3/14* (2006.01)
*H05B 6/64* (2006.01)

(52) U.S. Cl.
CPC ..... *H05B 3/141* (2013.01); *H05B 3/145* (2013.01); *H05B 6/6482* (2013.01)

(58) Field of Classification Search
USPC ..... 219/407–408, 536–537
See application file for complete search history.

(56) References Cited

U.S. PATENT DOCUMENTS

| | | | | |
|---|---|---|---|---|
| 6,037,572 | A * | 3/2000 | Coates | H05B 3/26 219/451.1 |
| 6,624,391 | B2 * | 9/2003 | Yamazaki | A47J 29/00 219/392 |
| 2009/0272728 | A1 * | 11/2009 | Abbott | F24C 7/04 219/399 |
| 2015/0305093 | A1 * | 10/2015 | Smith | A47J 31/542 219/391 |
| 2016/0187001 | A1 | 6/2016 | Bombardieri et al. | |

FOREIGN PATENT DOCUMENTS

| | | | |
|---|---|---|---|
| JP | 2007087930 | A | 4/2007 |
| JP | 2012199184 | A | 10/2012 |
| JP | 2015016178 | A | 1/2015 |
| KR | 100854155 | B1 | 8/2008 |
| KR | 101544312 | B1 | 8/2015 |

* cited by examiner

ELECTRIC OVEN

CROSS-REFERENCE TO RELATED APPLICATION

This application claims priority to Korean Patent Application No. 10-2016-0166883, filed on Dec. 8, 2016, and all the benefits accruing therefrom under 35 U.S.C. § 119, the content of which in its entirety is herein incorporated by reference.

BACKGROUND

1. Field

Embodiments of the disclosure relate to an electric oven, and more particularly, to an electric oven including planar heating elements in order to uniformly increase a temperature of an inside of a cavity.

2. Description of the Related Art

Ovens seal, heat, and cook food and may be generally classified into electric, gas, and electronic ovens according to heat sources of the ovens. Electric ovens may use an electric heater as a heat source, gas ovens may use heat resulting from combustion of gas as a heat source and microwave ovens may use friction heat of water molecules irradiated with high frequency waves as a heat source, for example.

Conventional electric ovens may accommodate the food in a box-shaped cooking space and cook the food by heat generated by an electric heater that is a heating source. In this regard, the electric heater may be arranged in one side portion inside a cavity provided in an electric oven and may heat the food by natural convection or forced convection by the above-described electric heater and a convection current.

SUMMARY

However, in an electric oven including an electric heater according to the related art, since the electric heater is arranged in one side portion of a cavity, there is a limit to a uniform increase in a temperature of the inside of the cavity, and since the electric heater is not easily detached from the electric oven, there is a problem in repairs or an exchange of parts.

Provided are electric ovens including a plurality of planar heating elements capable of applying heat to multiple surfaces of a cavity, thereby uniformly increasing a temperature of an inside of the cavity.

Additional embodiments will be set forth in part in the description which follows and, in part, will be apparent from the description, or may be learned by practice of the presented embodiments.

According to an embodiment of an embodiment, an electric oven includes a top plate and a bottom plate facing each other, two side plates facing each other, and a rear plate connecting the top plate where the top plate, the bottom plate, the two side plates and the rear plate define a cavity having a front opening, a door which selectively opens and closes the front opening of the cavity, a casing which surrounds the cavity, a support member interposed between the casing and the cavity, and at least one planar heating elements which extend along one plane, are detachably supported by the support member, and apply radiant heat to the cavity.

In an embodiment, each of the at least one planar heating elements may face one of the top plate, the bottom plate, two side plates, and the rear plate.

In an embodiment, a spaced distance between each of the at least one planar heating elements and one of the top plate, the bottom plate, two side plates, and the rear plate may range from about 0 millimeter (mm) to about 50 mm.

In an embodiment, the support member may include a support frame for supporting the at least one planar heating elements and a fastener detachably fastening the support frame and the at least one planar heating elements.

In an embodiment, when the support frame includes a plurality of support frames, the support member may further include a connection frame which connects the plurality of support frames that are adjacent to each other and maintains a predetermined gap with the cavity.

In an embodiment, the at least one planar heating elements may be interposed between the connection frame and the cavity.

In an embodiment, the at least one planar heating elements may be interposed between the connection frame and the casing.

In an embodiment, the electric oven may further include an electrical insulating layer interposed between the at least one planar heating elements and the support frame.

In an embodiment, the at least one planar heating elements may be heated at a high temperature below about 600 degrees Celsius (° C.).

In an embodiment, the electric oven may further include an insulating member interposed between the casing and the at least one planar heating elements.

In an embodiment, the electric oven may further include a temperature sensor which measures a temperature of an inside of the cavity, and a controller which controls the at least one planar heating elements according to a result of the temperature measurement by the temperature sensor.

In an embodiment, the electric oven may further include a connector which separably connects the at least one planar heating elements and the controller.

In an embodiment, the at least one planar heating elements may include a substrate extending in one direction, a first electrode and a second electrode provided in both ends of the substrate, and a heating layer provided on the substrate and contacting the first electrode and the second electrode.

In an embodiment, the heating layer may include one of a carbon nano tube ("CNT") and a conductive oxide layer, where the conductive oxide layer includes at least one of $RuO_2$, $MnO_2$, $VO_2$, $TaO_2$, $IrO_2$, $NbO_2$, $WO_2$, $GaO_2$, $MoO_2$, $InO_2$, $CrO_2$, and $RhO_2$.

In an embodiment, the at least one planar heating elements may face each other in the top plate, the bottom plate, two side plates, and the rear plate.

The at least one planar heating elements may be fixed to one of the top plate, the bottom plate, two side plates, and the rear plate.

In an embodiment, the at least one planar heating elements may be heated at a high temperature below about 600° C.

In an embodiment, the at least one planar heating elements may be arranged in the top plate, the bottom plate, two side plates, or the rear plate.

BRIEF DESCRIPTION OF THE DRAWINGS

These and/or other embodiments will become apparent and more readily appreciated from the following description of the embodiments, taken in conjunction with the accompanying drawings in which.

DETAILED DESCRIPTION

Figure 1:
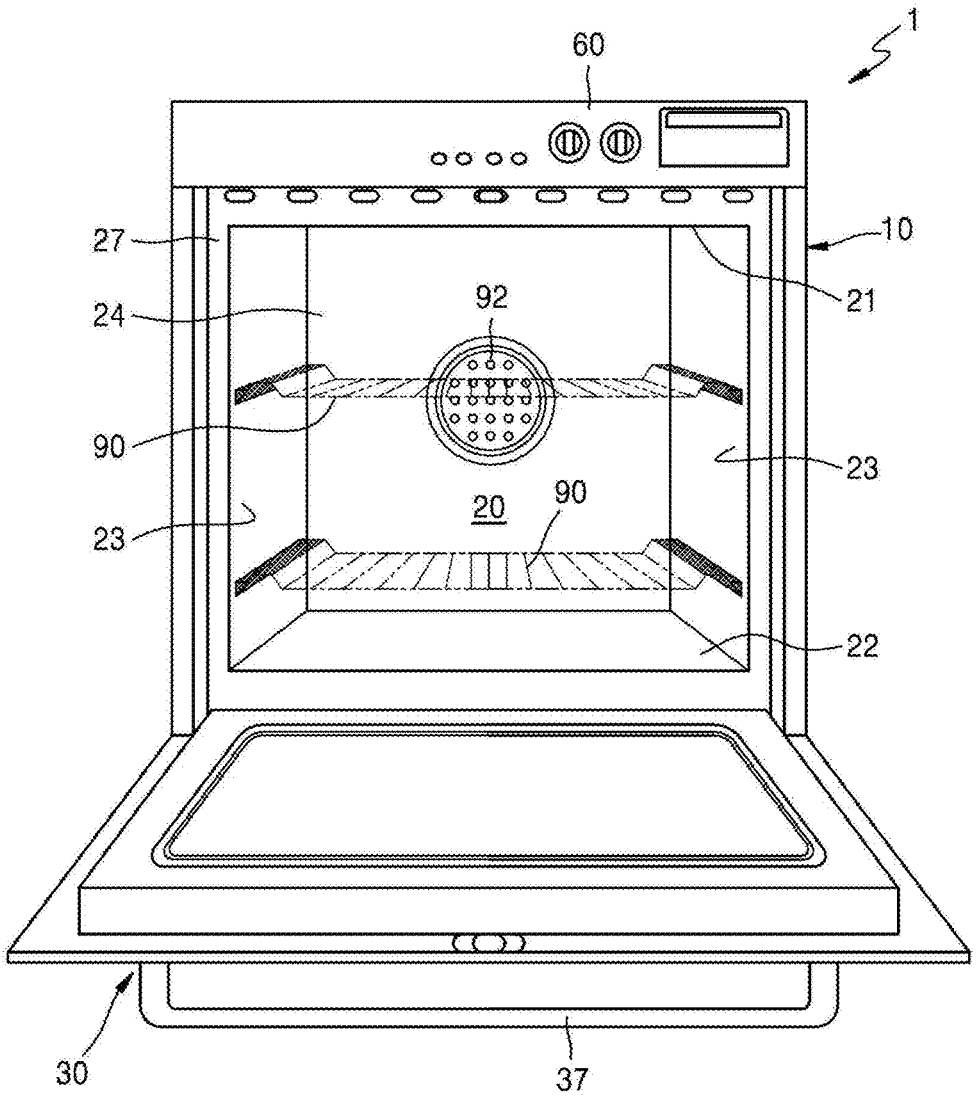
FIG. 1 illustrates an embodiment of an electric oven.

Reference will now be made in detail to embodiments, examples of which are illustrated in the accompanying drawings, where like reference numerals refer to like elements throughout. In this regard, the embodiments may have different forms and should not be construed as being limited to the descriptions set forth herein. Accordingly, the embodiments are merely described below, by referring to the drawing figures, to explain embodiments. Expressions such as "at least one of," when preceding a list of elements, modify the entire list of elements and do not modify the individual elements of the list.

Throughout the specification, it will be understood that when a unit is referred to as being "connected" to another element, it may be "directly connected" to the other element or "electrically connected" to the other element in a state in which intervening elements are present. In addition, it will be understood that when a unit is referred to as "comprising" another element, it does not preclude the possibility that one or more other elements may exist or may be added.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Figure 2:
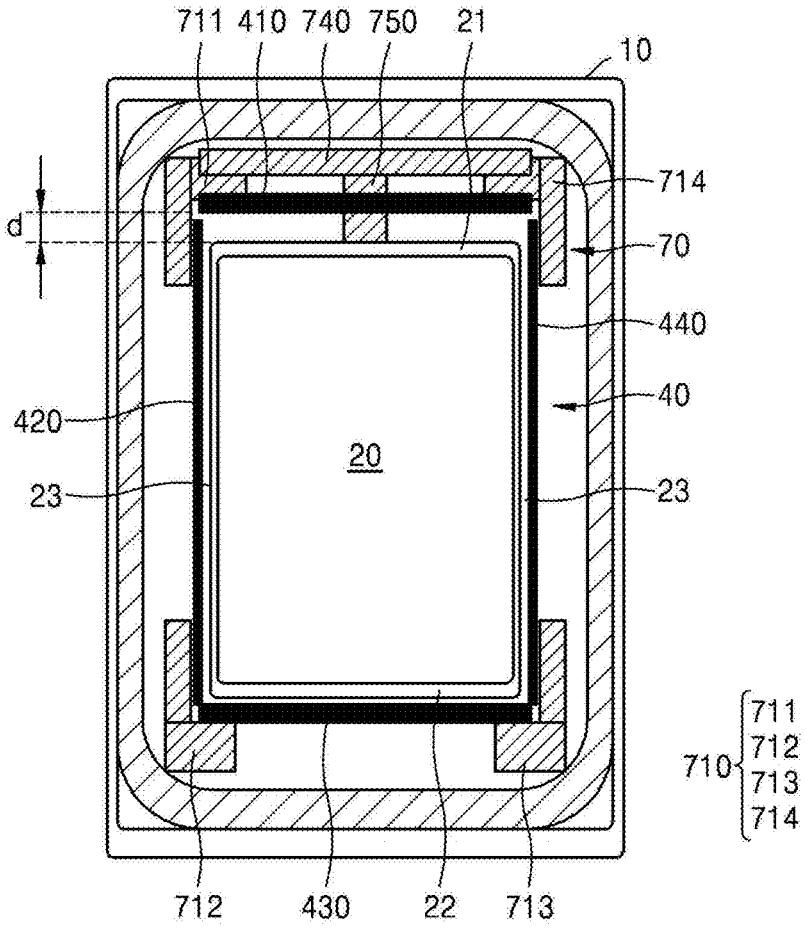
FIG. 2 is a cross-sectional view of an embodiment of an electric oven.

FIG. 1 illustrates an electric oven 1 according to an embodiment. FIG. 2 is a cross-sectional view of the electric oven 1 according to an embodiment.

The electric oven 1 may include a casing 10 and a cavity 20 having a front opening may be defined inside the casing 10. The electric oven 1 may form an exterior appearance by including a door 30 rotatably coupled to one side of the casing 10 so as to open/close the front opening of the cavity 20.

The cavity 20 may be a cooking space defined by a top plate 21, a bottom plate 22, two side plates 23, and a rear plate 24. A front plate 27 may be provided in front of the cavity 20 to form the front opening. Various parts constituting the electric oven 1 may be embedded in a space provided between the cavity 20 and the casing 10.

At least one rack 90 may be arranged inside the cavity 20 to place food thereon. A rail (not shown) may be installed in inner surfaces of two side plates 23 so as to detach the rack 90. A user may take or put the food off or on the rack 90 while moving the rack 90 through the rail.

The door 30 may be hinge-coupled to a lower portion of the casing 10 such that the user may open/close the cavity 20. A handle 37 may be attached onto an upper portion of the door 30 in order for the user to conveniently rotate the door 30.

A vent 92 may be installed in the rear plate 24 in order for air inside the cavity 20 to be discharged to the outside. However, the invention is not limited thereto, and in an embodiment, the vent 92 may be installed in the top plate 21. The vent 92 may be provided through the top plate 21 in order for the air inside the cavity 20 to pass through. A filter (not shown) may be installed in the vent 92 to filter contamination materials from the air discharged from the cavity 20.

Figure 3A:
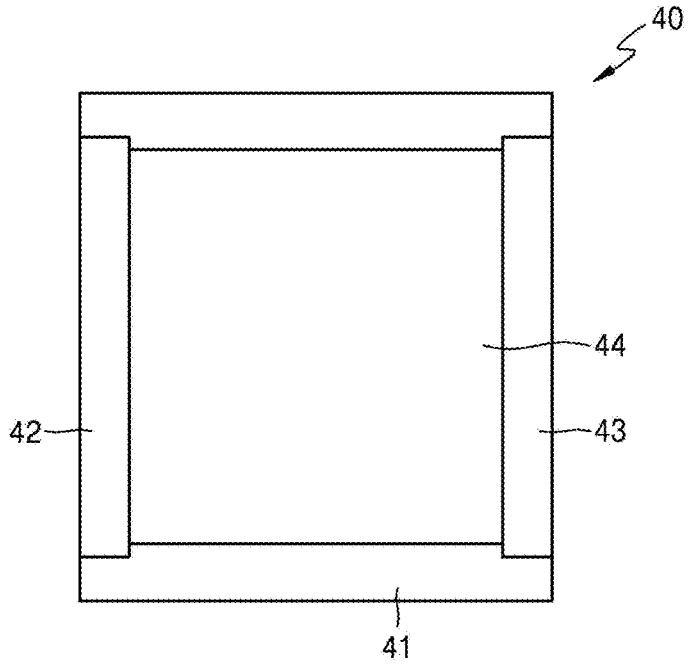
FIG. 3A is a schematic plan view of an embodiment of a planar heating element.
Figure 3B:
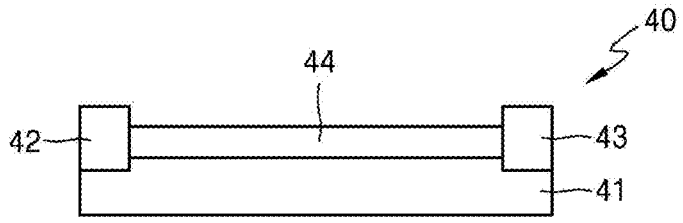
FIG. 3B is a schematic lateral view of an embodiment of a planar heating element.

A planar heating element 40 may be a heating member that is interposed between the casing 10 and the cavity 20 and applies radiant heat to the cavity 20. In an embodiment, the planar heating element 40 may, as shown in FIGS. 3A and 3B, have a planar shape extending along one planar surface and may include a substrate 41, a first electrode 42, a second electrode 43, and a heating layer 44, for example. In this regard, for example, a plastic substrate or a glass substrate may be used as the substrate 41. The first electrode 42 and the second electrode 43 may be arranged on both ends of the substrate 41 to be directly in contact with the substrate 41. In an embodiment the first electrode 42 and the second electrode 43 may include a material having excellent electric conductivity, for example. In an embodiment the first electrode 42 and the second electrode 43 may include at least one of silver (Ag), aluminum (Al), indium tin oxide ("ITO"), copper (Cu), molybdenum (Mo), and platinum (Pt), for example.

The heating layer 44 may be provided on the substrate 41 and may be in contact with the first electrode 42 and the second electrode 43. The heating layer 44 may include an inorganic complex material including an inorganic material and an inorganic conducive material. In an embodiment the heating layer 44 may include carbon nanotubes ("CNTs"), for example, any one of single-wall CNT, double-wall CNT, multi-wall CNT, and twisted CNT, or a combination of at least two thereof, for example. The heating layer 44 may include a conductive oxide film. In an embodiment, the conductive oxide film may include at least one of $RuO_2$, $MnO_2$, $VO_2$, $TaO_2$, $IrO_2$, $NbO_2$, $WO_2$, $GaO_2$, $MoO_2$, $InO_2$, $CrO_2$, and $RhO_2$, or any combination thereof, for example, but the disclosure is not limited thereto.

The planar heating element 40 may include one or more planar heating elements 40 each facing one of the top plate 21, the bottom plate 22, the two side plates 23, and the rear plate 24 that define the cavity 20 and may be heated at a high temperature below about 600 degrees Celsius (° C.), for example. In an embodiment the planar heating element 40 may include five planar heating elements 40 respectively facing each of the top plate 21, the bottom plate 22, two side plates 23, and the rear plate 24 that define the cavity 20, for example. In this regard, each of the planar heating elements 40 and each of the top plate 21, the bottom plate 22, and two side plates 23 that define the cavity 20 may be spaced apart from each other by a predetermined spaced distance d. In an embodiment the spaced distance d may range from about 0 millimeter (mm) to about 50 nm and from about 0 mm to about 30 mm, for example, but the disclosure is not limited thereto. As described above, the planar heating element 40 may face the top plate 21, the bottom plate 22, two side plates 23, and the rear plate 24 that define the cavity 20, thereby not only increasing a heating rate inside of the cavity 20 but also generating a uniform temperature rise inside of the cavity 20.

In order to insulate the cavity 20 from the outside, an insulating member 50 may be interposed between the casing 10 and each of the top plate 21, the bottom plate 22, and two side plates 23 that define the cavity 20. A control panel 60 may be installed on an upper portion of the casing 10 to control operation of the electric oven 1.

A support member 70 may be a support structure that is interposed between the casing 10 and the cavity 20 to support the planar heating element 40. In an embodiment the support member 70 may include a plurality of support frames 710 for supporting the planar heating element 40 and a fastener 730 (refer to FIG. 4A) for detachably fastening the support frames 710 and the planar heating element 40, for example.

A structure for supporting the planar heating element 40 between the casing 10 and the cavity 20 by the support member 70 will be described in more detail below.

Figure 4A:
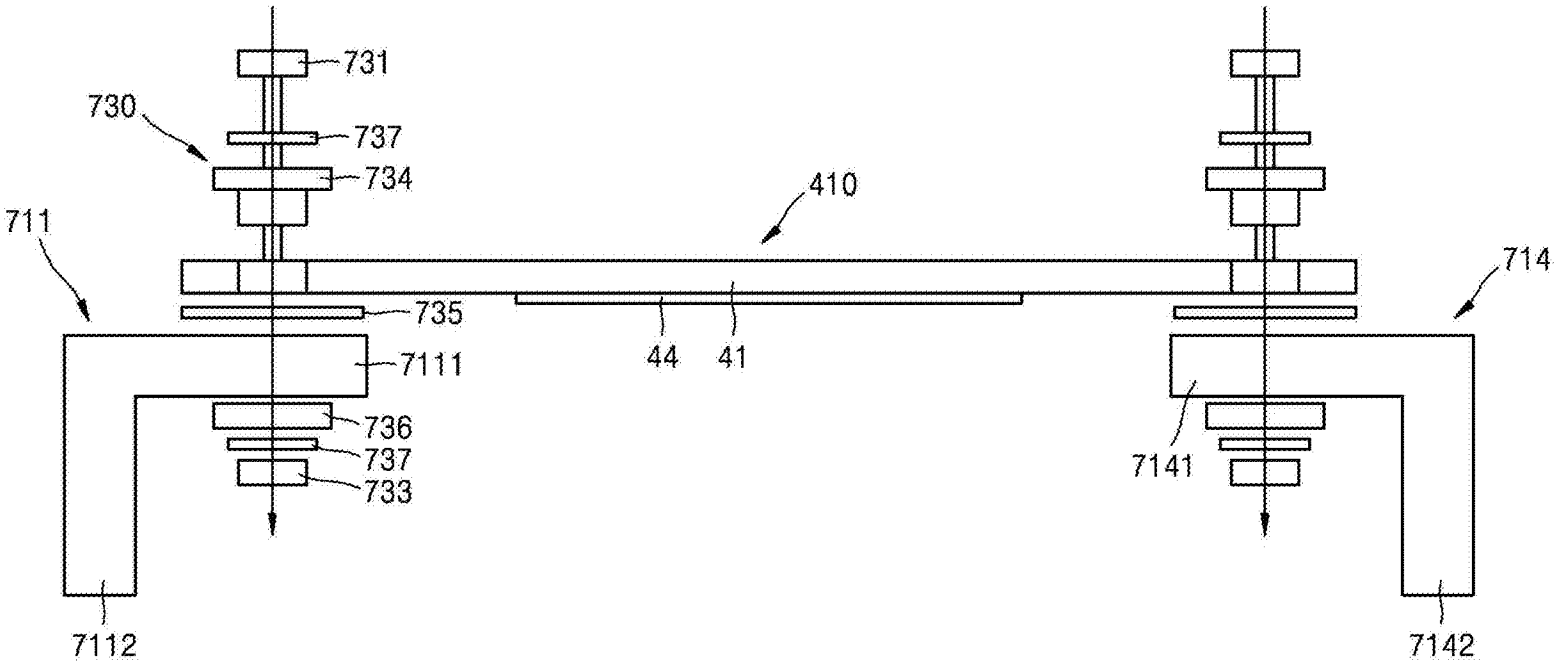
FIG. 4A is a schematic view of an embodiment of a fastener.
Figure 4B:
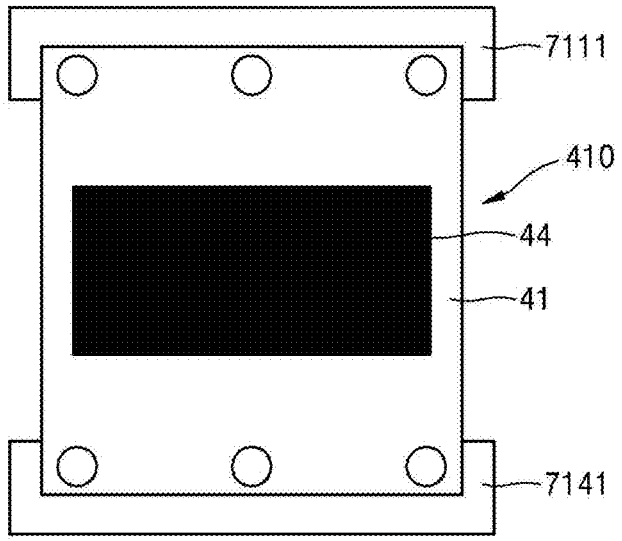
FIG. 4B is a schematic view of an embodiment of planar heating elements and support frames.
Figure 4C:
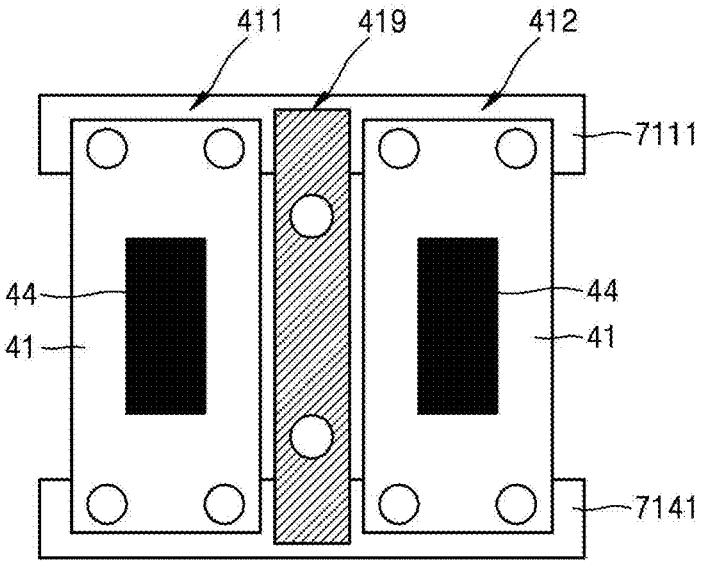
FIG. 4C is a schematic view of another embodiment of planar heating elements and support frames.

FIG. 4A is a schematic view of the fastener 730 according to an embodiment. FIG. 4B is a schematic view of planar heating elements and support frames according to an embodiment. FIG. 4C is a schematic view of planar heating elements and support frames according to another embodiment.

The support member 70 may include the plurality of support frames 710 for supporting the planar heating element 40 as described above. In an embodiment, when a first planar heating element 410 is arranged in correspondence to the top plate 21 of the cavity 20, a second planar heating element 420 and a fourth planar heating element 440 are arranged in correspondence to two side plates 23, and a third planar heating element 430 is arranged in correspondence to the bottom plate 22 as shown in FIG. 2, a first support frame 711 for supporting the first and second planar heating elements 410 and 420, a second support frame 712 for supporting the second and the third planar heating elements 420 and 430, a third support frame 713 for supporting the third and fourth planar heating elements 430 and 440, and a fourth support frame 714 for supporting the fourth and first planar heating elements 440 and 410 may be arranged, for example.

The support frame 710 according to an embodiment may have a cross section extending in two directions so as to support the two planar heating elements 40. In an embodiment as shown in FIGS. 4A through 4C, the first support frame 711 may include a first loader 7111 extending in parallel to the first planar heating element 410 and a second loader 7112 extending in parallel to the second planar heating element 420, for example. In this regard, the first and second loaders 7111 and 7112 may be connected to each other. Also, the fourth support frame 714 may include a third loader 7141 extending in parallel to the first planar heating element 410 and a fourth loader 7142 extending in parallel to the fourth planar heating element 440. In this regard, the third and fourth loaders 7141 and 7142 may be connected to each other.

In an embodiment, the first planar heating element 410 may be interposed between the first loader 7111 and the third loader 7141 so that the first loader 7111 and the third loader 7141 may detachably support the first planar heating element 410 in one or more locations along a length direction, for example. In this regard, the first planar heating element 410 may be unitary as one substrate 41 on which the heating layer 44 is arranged as shown in FIG. 4B or may be separately provided as a 1-1th planar heating element 411 and a 1-2th planar heating element 412 as shown in FIG. 4C. When the first planar heating element 410 is separately provided, a connector supporter 419 may be interposed between the 1-1th planar heating element 411 and the 1-2th planar heating element 412 in order to support the 1-1th planar heating element 411 and the 1-2th planar heating element 412.

As described above, the planar heating element 40 may detachably support the support frame 710. To this end, the fastener 730 may be arranged to fasten the planar heating element 40 and the support frame 710. In an embodiment the fastener 730 may detachably fasten the first planar heating element 410 and the first loader 7111 of the first support frame 710 by a nut and bolt structure as shown in FIG. 4A, for example. In this regard, the fastener 730 may include a bolt 731 extending in one direction and first and second nuts 733 and 734 that may be fastened to both ends of the bolt 731. In this regard, the second nut 734 may be a flange nut including an insulating material and may be arranged in a though hole defined in the first loader 7111 and the first planar heating element 410. A first electrical insulating layer 735 including an insulating material may be interposed between the first loader 7111 and the first planar heating element 410. A second electrical insulating layer 736 including an insulating material may be interposed between the first loader 7111 and the first nut 733. A washer 737 may be arranged between the bold 731 and the second nut 734 and between the first nut 733 and the second electrical insulating layer 736 but the disclosure is not limited thereto.

When the fastener 730 is arranged as described above, the first loader 7111, i.e. the first support frame 711, and the first planar heating element 410 may be detachably fastened by the bolt 731, the first nut 733, and the second nut 734. Accordingly, the planar heating element 40 (refer to FIGS. 2 to 3B) may be arranged independently from the support frame 710 (refer to FIG. 2), and thus a process of assembling or repairing the planar heating element 40 may be more easily performed. A method of supporting the second through fourth planar heating elements 420 through 440 (refer to FIG. 2) is also substantially the same as a method of supporting the first planar heating element 410, and thus descriptions thereof are omitted here for convenience of description.

Figure 5:
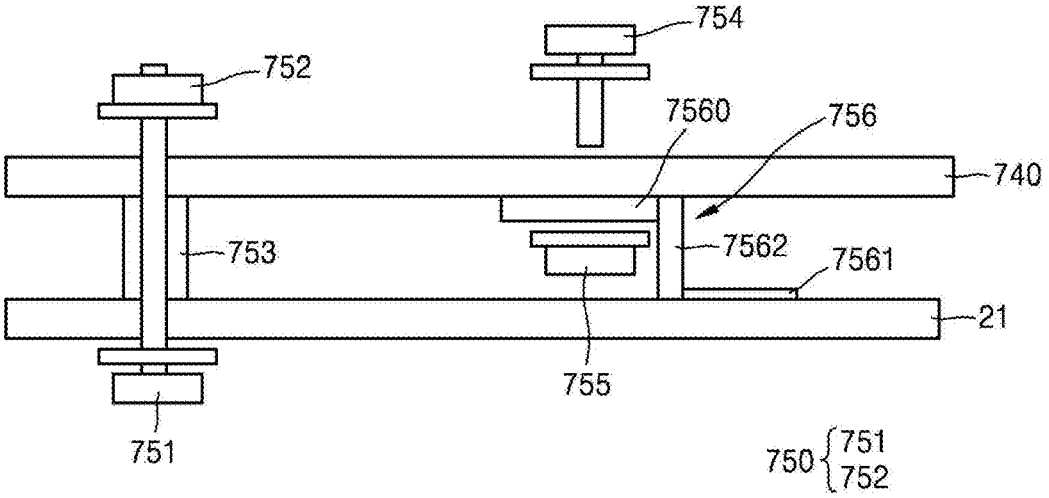
FIG. 5 is a schematic view of an embodiment of a connection frame and a connector.
Figure 6:
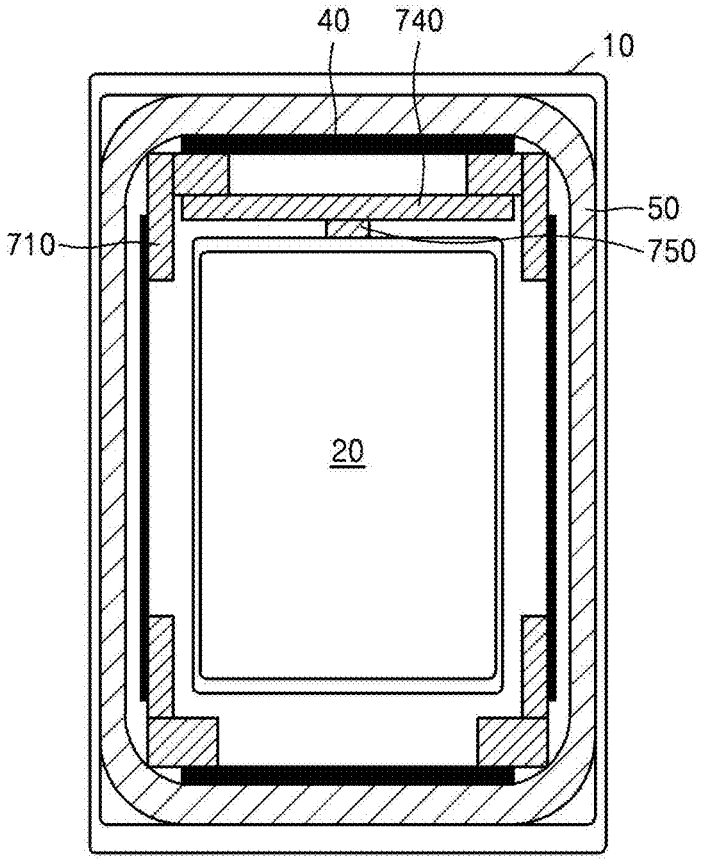
FIG. 6 is a cross-sectional view of another embodiment of an electric oven.

FIG. 5 is a schematic view of a connection frame 740 (refer to FIG. 2) and a connector 750 (refer to FIG. 2), according to an embodiment. FIG. 6 is a cross-sectional view of the electric oven 1 (refer to FIG. 1) according to another embodiment.

As shown in FIG. 2, when the plurality of support frames 710, for example, the first through fourth support frames 711 through 714, are arranged, the connection frame 740 may be used to connect each of the support frames 710. In this regard, the connection frame 740 may be arranged such that the cavity 20 and the planar heating element 40 may be spaced apart from each other by a predetermined gap. In an embodiment referring to FIG. 5, the connection frame 740 may be provided in a loader shape extending between the first support frame 710 and the second support frame 720, for example. In this regard, the connection frame 740 may be spaced apart from the cavity 20, for example, the top plate 21, by a predetermined gap.

In this regard, the connection frame 740 may be supported by the connector 750 to be spaced apart from the cavity 20 by a predetermined gap. In an embodiment the connector 750 may include a first bolt 751 to pass through the cavity 20 and the connection frame 740 and a nut 752 arranged in one end of the first bolt 751, for example. In this regard, a first gap maintainer 753 may be interposed between the connection frame 740 and the top plate 21 to maintain a gap between the connection frame 740 and the top plate 21 and to have a hollow loader shape through which the first bolt 751 may pass. To prevent deformation of the connection frame 740 having a predetermined length caused by a load, a second bolt 754 may be arranged in a spaced location along a length direction of the connection frame 740 from the first bolt 751.

The second bolt 754 may pass through the connection frame 740. A third nut 755 may be interposed between the connection frame 740 and the cavity 20 to fasten the connection frame 740 and a second gap maintainer 756. In an embodiment the second gap maintainer 756 may include a first support surface 7560 contacting the connection frame 740, a second support frame 7561 contacting the top plate 21 of the cavity 20, and a support connector 7562 connecting the first support surface 7560 and the second support surface 7561, for example. The support connector 7562 may extend in a spaced direction of the connection frame 740 and the cavity 20 and may be interposed between the connection frame 740 and the cavity 20, thereby supporting the connection frame 740 and the cavity 20 to maintain a predetermined gap. In the above-described embodiment, the first and second gap maintainers 753 and 756 may be used together to maintain the predetermined gap between the connection frame 740 and the cavity 20 but the disclosure is not limited thereto. In another embodiment, only a plurality of first gap maintainers 753 or only a plurality of second gap maintainer 756 may be used, for example.

The connection frame 740 and the planar heating element 40 may be differently arranged according to a purpose of use. In an embodiment as shown in FIGS. 2 and 5, the planar heating element 40 may be interposed between the connection frame 740 and the cavity 20, for example. As another example, as shown in FIG. 6, the planar heating element 40 may be interposed between the connection frame 740 and the casing 10. When the planar heating element 40 is interposed between the connection frame 740 and the cavity 20 as described above, the planar heating element 40 may be more easily separated from the support frame 710, thereby more easily repairing the electric oven 1, whereas, when the planar heating element 40 is interposed between the connection frame 740 and the casing 10, a space efficiency between the casing 10 and the cavity 20 may be increased, thereby making the electric oven 1 smaller.

Figure 7:
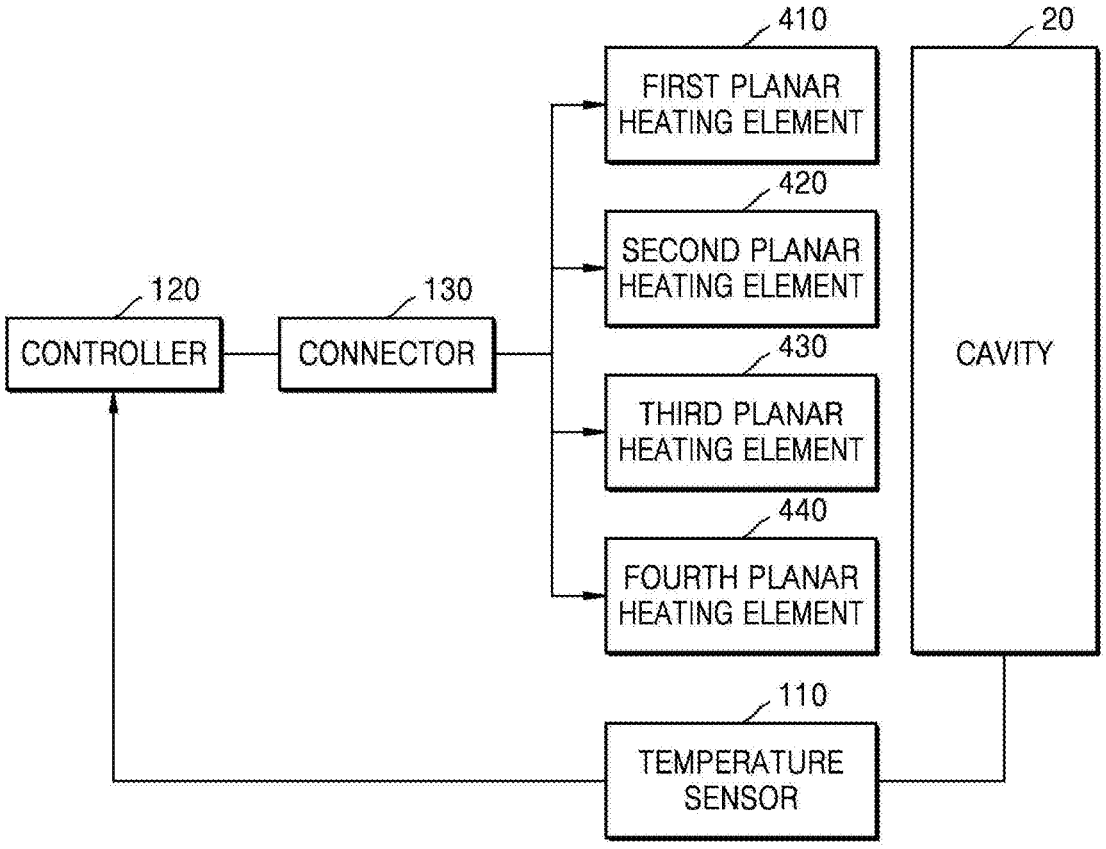
FIG. 7 is a block diagram of an embodiment of planar heating elements and a controller.
Figure 8A:
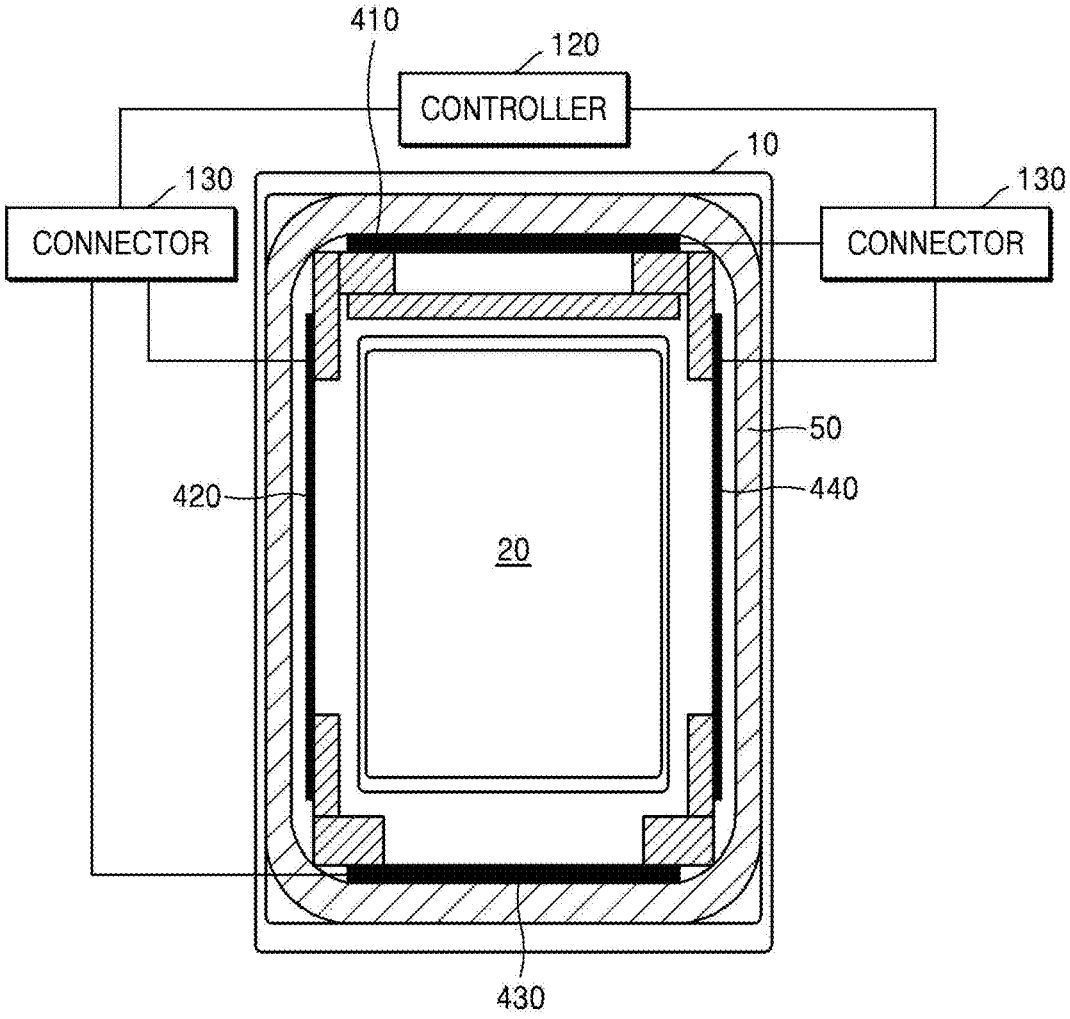
FIG. 8A is a cross-sectional view of an embodiment of an electric oven for describing a connection relationship between planar heating elements and connectors.
Figure 8B:
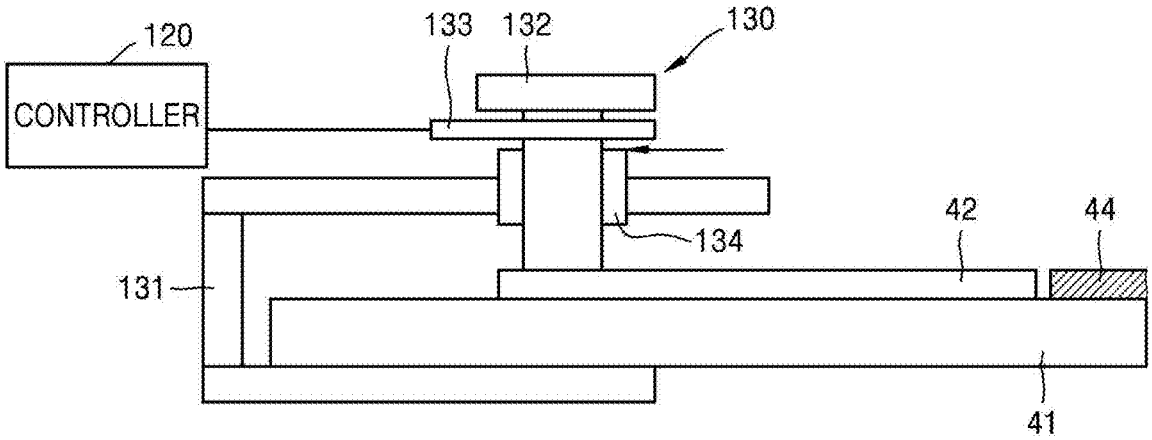
FIG. 8B is a schematic view of an embodiment of a connector and a planar heating element.

FIG. 7 is a block diagram of the planar heating elements 410, 420, 430, and 440 and a controller 120 according to an embodiment. FIG. 8A is a cross-sectional view of the electric oven 1 for describing a connection relationship between the planar heating elements 410, 420, 430, and 440 and the connectors 130 according to an embodiment. FIG. 8B is a schematic view of the connector 130 and the planar heating elements 40 according to an embodiment.

The one or more planar heating elements 40 that are arranged outside the cavity 20 and apply heat to the cavity 20 may be controlled, thereby adjusting a temperature rise rate and a temperature equilibrium degree of an inside of the cavity 20. In an embodiment the electric oven 1 may further include a temperature sensor 110 for measuring a temperature of the inside of the cavity 20 and the controller 120 for controlling the planar heating element 40, for example.

The temperature sensor 110 may be a sensing device for sensing the temperature of the inside of the cavity 20. In an embodiment the temperature sensor 110 may sense a temperature change of the inside of the cavity 20 and may transmit sensed data to the controller 120 that will be described later, for example. In an embodiment the temperature sensor 10 may include a contact type or a non-contact type sensor and may include a plurality of sensors that may be uniformly arranged in an entire area of the cavity 20, for example.

The controller 120 may be a hardware controlling general functions and operations of the electric oven 1. The controller 120 may be implemented as one microprocessor module or a combination of two or more microprocessor modules. That is, an implementation form of the controller 120 is not limited by any one form.

In an embodiment, the above-described controller 120 may execute a program stored in a memory (not shown) to control the one or more planar heating elements 40, e.g., the first through fourth planar heating elements 410 through 440, by the temperature change of the inside of the cavity 20 measured by the temperature sensor 110, for example. In an embodiment when a temperature of a location of the cavity 20 of FIG. 2 adjacent to the bottom plate 22 is higher than a temperature of a location thereof adjacent to the top plate 21, the second planar heating element 420 arranged to face the bottom plate 22 may be controlled to apply additional heat to the bottom plate 22 of the cavity 20, thereby achieving an entire temperature equilibrium of the inside of the cavity 20, for example.

In addition, according to an embodiment, the connector 130 may be interposed between the controller 120 and the planar heating element 40 to achieve an independent separability from the planar heating element 40. In an embodiment the connector 130 may be a connection device that is connected to the controller 120 in one direction and is electrically connected to first and second electrodes 42 and 43 (refer to FIGS. 3A and 3B) provided in the planar heating element 40 in another direction, for example. In this regard, the connector 130 may be connected to the first and second electrodes 42 and 43 so as to be easily detached from the planar heating element 40, for example. In an embodiment the connector 130 may be detachably connected to a frame support 131, the first electrode 42, or the second electrode 43 that may support the planar heating element 40 and may include a fastener 132 that may be electrically connected to the first electrode 42 or the second electrode 43 and an insulator 134 in a hollow loader shape for electrically insulating the fastener 132 and the frame supporter 131, for example. As described above, the separable connector 130 may be interposed between the controller 120 and the planar heating element 40, and thus the controller 120 may control the planar heating element 40 to operate. When the planar heating element 40 is broken or needs repair, the fastener 132 may be used to separate the planar heating element 40 and the controller 120 from each other. The connector 130 may be connected to the first and second electrodes 42 and 43 in series or in parallel, and may include a heat resistance material so as to protect a mechanical damage from the cavity 20 of a high temperature.

Figure 9:
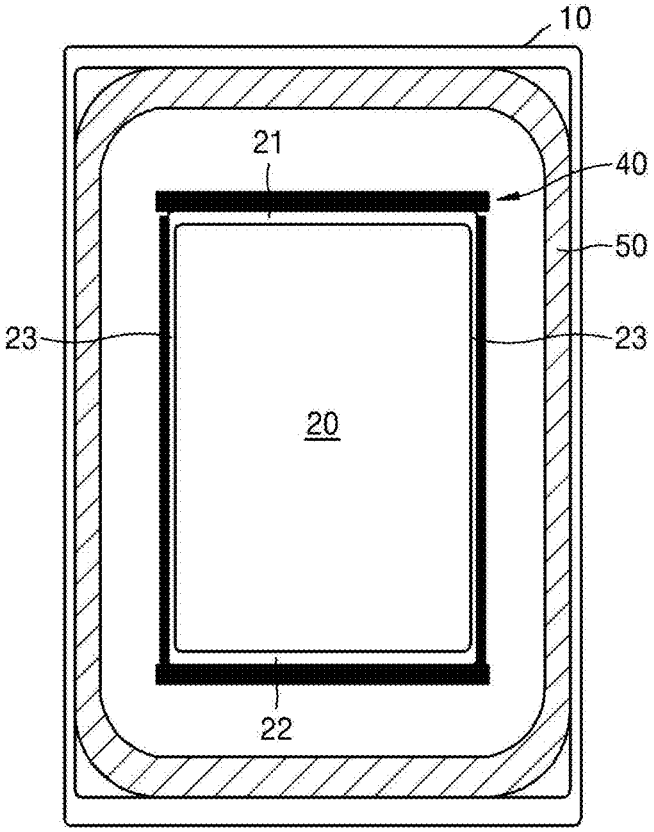
FIG. 9 is a cross-sectional view of another embodiment of an electric oven.
Figure 10:
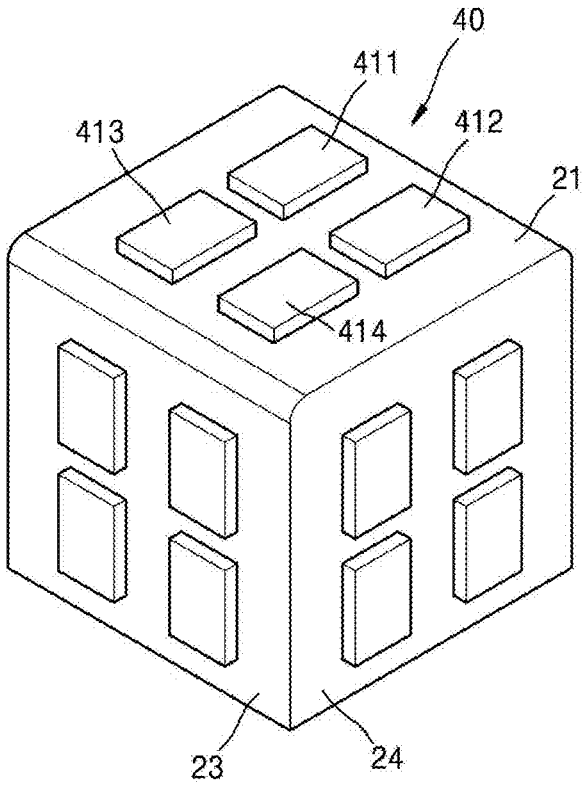
FIG. 10 is a schematic view of an embodiment of a planar heating element arranged in a cavity.

FIG. 9 is a cross-sectional view of an electric oven according to another embodiment. FIG. 10 is a schematic view of the planar heating element 40 arranged in a cavity according to an embodiment. For convenience of description, descriptions of configurations of FIGS. 9 and 10 that are substantially the same as configurations of FIGS. 1 and 2 are omitted.

Referring to FIGS. 9 and 10, the planar heating element 40 according to an embodiment may include one or more planar heating elements 40 each facing one of the top plate 21, the bottom plate 22, two side plates 23, and the rear plate 24 that define the cavity 20 and may be heated at a high temperature below about 600° C., for example. In an embodiment the planar heating element 40 may include the five planar heating elements 40 each facing each of the top plate 21, the bottom plate 22, two side plates 23, and the rear plate 24 that define the cavity 20, for example. In this regard, each of the planar heating elements 40 may be fixed to each of the top plate 21, the bottom plate 22, and two side plates 23 that define the cavity 20. As described above, the planar heating element 40 may face the top plate 21, the bottom plate 22, two side plates 23, and the rear plate 24 that define the cavity 20, thereby not only increasing a heating rate of an inside of the cavity 20 but also generating a uniform temperature rise of the inside of the cavity 20.

Not only the single planar heating element 40 but also the plurality of planar heating elements 40 may be arranged in the top plate 21, the bottom plate 22, two side plates 23, and the rear plate 24 that define the cavity 20. The plurality of planar heating elements 40 according to an embodiment, for example, the 1-1th planar heating element 411, the 1-2th planar heating element 412, the 1-3th planar heating element 413, and the 1-4$^{th}$ planar heating element 414, may be supported by one of the cavity 20 as shown in FIG. 10. In this regard, each of the 1-1th planar heating element 411, the 1-2th planar heating element 412, the 1-3th planar heating element 413, and the 1-4$^{th}$ planar heating element 414 may be controlled by the controller 120, thereby more precisely adjusting a temperature of the inside of the cavity 20.

An electric oven according to embodiments may employ a planar heating element as an electric heater, thereby relatively uniformly increasing a temperature of an inside of a cavity and accordingly enhancing a heating uniformity with respect to food.

The electric hater may be arranged outside the cavity, and thus it is relatively easy to repair the electric oven and exchange parts thereof. A shape of the cavity may be relatively freely modified, thereby achieving electrical insulation between the cavity and the electric heater.

While the disclosure has been particularly shown and described with reference to embodiments thereof, it will be understood by one of ordinary skill in the art that various changes in form and details may be made therein without departing from the spirit and scope of the invention as defined by the following claims. Hence, it will be understood that the embodiments described above are not limiting of the scope of the invention. In an embodiment each component described in a single type may be executed in a distributed manner, and components described distributed may also be executed in an integrated form, for example.

It should be understood that embodiments described herein should be considered in a descriptive sense only and not for purposes of limitation. Descriptions of features or embodiments within each embodiment should typically be considered as available for other similar features or embodiments in other embodiments.

While one or more embodiments have been described with reference to the drawing figures, it will be understood by those of ordinary skill in the art that various changes in form and details may be made therein without departing from the spirit and scope as defined by the following claims.

What is claimed is:

1. An electric oven comprising:

a top plate and a bottom plate facing each other, two side plates facing each other, and a rear plate connecting the top plate, the bottom plate and the two side plates where the top plate, the bottom plate, the two side plates and the rear plate define a cavity having a front opening;

a door which selectively opens and closes the front opening of the cavity;

a casing which surrounds the cavity;

a support member interposed between the casing and the cavity; and at least one planar heating elements which extend along one plane, are detachably supported by the support member, and apply radiant heat to the cavity, wherein the support member comprises a plurality of support frames for supporting the at least one planar heating elements, and wherein the support member further comprises a connection frame which connects the plurality of support frames which are adjacent to each other and maintain a predetermined gap with the cavity.

2. The electric oven of claim 1, wherein the support member comprises a fastener detachably fastening the support frame and the at least one planar heating elements.

3. The electric oven of claim 1, wherein the at least one planar heating elements are interposed between the connection frame and the cavity.

4. The electric oven of claim 1, wherein the at least one planar heating elements are interposed between the connection frame and the casing.

5. The electric oven of claim 1, further comprising: an electrical insulating layer interposed between the at least one planar heating elements and the support frame.

6. The electric oven of claim 1, wherein the at least one planar heating elements are heated at a high temperature below 600 degrees Celsius.

7. The electric oven of claim 1, further comprising:

an insulating member interposed between the casing and the at least one planar heating elements.

8. The electric oven of claim 1, wherein each of the at least one planar heating elements face one of the top plate, the bottom plate, two side plates, and the rear plate.

9. The electric oven of claim 8, wherein a spaced distance between each of the at least one planar heating elements and one of the top plate, the bottom plate, two side plates, and the rear plate ranges from 0 millimeter to 50 millimeters.

10. The electric oven of claim/wherein the at least one planar heating elements face each other in the top plate, the bottom plate, two side plates, and the rear plate.

11. The electric oven of claim 1, further comprising:

a temperature sensor which measures a temperature of an inside of the cavity; and a controller which controls the at least one planar heating elements according to a result of the temperature measurement by the temperature sensor.

12. The electric oven of claim 11, further comprising:

a connector which separably connects the at least one planar heating elements and the controller.

13. The electric oven of claim 11, wherein the at least one planar heating elements are arranged in the top plate, the bottom plate, two side plates, or the rear plate.

14. The electric oven of claim 1, wherein the at least one planar heating elements comprise a substrate extending in one direction, a first electrode and a second electrode provided in both ends of the substrate, and a heating layer provided on the substrate and contacting the first electrode and the second electrode.

15. The electric oven of claim 14, wherein the heating layer comprises one of a carbon nano tube and a conductive oxide layer, wherein the conductive oxide layer comprises at least one of $Ru_2$, $MnO_2$, $VO_2$, $Ta_2$, $IrO_2$, $NbO_2$, $WO_2$, $GaO_2$, $MoO_2$, $InO_2$, $CrO_2$, and $RhO_2$.

16. The electric oven of claim 1, wherein the at least one planar heating elements are fixed to one of the top plate, the bottom plate, two side plates, and the rear plate.

17. The electric oven of claim 16, wherein the at least one planar heating elements are heated at a high temperature below 600 degrees Celsius.

* * * * *